US008789240B2

(12) United States Patent
Bouwman

(10) Patent No.: US 8,789,240 B2
(45) Date of Patent: Jul. 29, 2014

(54) HINGE FOR A PANEL DOOR, IN PARTICULAR FOR A COOLING CUPBOARD

(75) Inventor: Evert Bouwman, Harderwijk (NL)

(73) Assignee: Estem B.V., Harderwijk (NL)

( * ) Notice: Subject to any disclaimer, the term of this patent is extended or adjusted under 35 U.S.C. 154(b) by 0 days.

(21) Appl. No.: 13/273,377

(22) Filed: Oct. 14, 2011

(65) Prior Publication Data

US 2012/0091867 A1 Apr. 19, 2012

(30) Foreign Application Priority Data

Oct. 14, 2010 (NL) ..... 2005520

(51) Int. Cl.
*E05D 5/02* (2006.01)
*E05D 11/00* (2006.01)
*E05D 11/10* (2006.01)

(52) U.S. Cl.
USPC ..... 16/252; 16/382; 16/334; 49/388

(58) Field of Classification Search
USPC ..... 16/252, 334, 335, 273, 274, 382, 344; 49/381, 397, 398, 386, 388; 4/241
See application file for complete search history.

(56) References Cited

U.S. PATENT DOCUMENTS 4,416,086 A * 11/1983 Niekrasz ..... 49/388
5,283,978 A * 2/1994 Horgan, Jr. ..... 49/388
5,297,313 A * 3/1994 Brin ..... 16/252
5,542,721 A * 8/1996 Allen ..... 292/194
5,771,538 A * 6/1998 Huppert, Sr. ..... 16/274
5,867,869 A * 2/1999 Garrett et al. ..... 16/252
5,918,347 A * 7/1999 Morawetz ..... 16/322
6,070,294 A * 6/2000 Perkins et al. ..... 16/252
6,161,255 A * 12/2000 Garrett ..... 16/284
6,481,055 B2 * 11/2002 Cheng ..... 16/252
6,519,811 B1 * 2/2003 Cheng ..... 16/252
6,560,821 B2 * 5/2003 Miller et al. ..... 16/252
6,568,032 B1 * 5/2003 Ramsauer ..... 16/329

(Continued)

FOREIGN PATENT DOCUMENTS

CN 201614827 U * 10/2010
EP 792990 A1 * 9/1997 ..... E05D 11/10
EP 867586 A2 * 9/1998 ..... E05D 11/10
WO WO 2004085780 A1 * 10/2004 ..... E05D 11/10

OTHER PUBLICATIONS

Search Report dated Jun. 8, 2011, corresponding to the Foreign Priority Application No. NL 2005520.

*Primary Examiner* — Victor Batson
*Assistant Examiner* — Jason W San
(74) *Attorney, Agent, or Firm* — Young & Thompson

(57) ABSTRACT

Hinge for a panel door, in particular a glass door, for sealing a space, such as for example a cooling cupboard, wherein the hinge (1) includes a sill/lintel-attachment part (2), two mutually connectable clamping parts (3, 4) for clamping a panel (21) in between them along an edge of the panel (21), a pivot pin (6) which connects, on one side, to the sill/lintel-attachment part (2) and, on the other side, to the clamping parts (3, 4) in such a manner that they can pivot with respect to one another, and tensioning parts (7, 8, 9) which force the sill/lintel-attachment part (2) into a neutral position with respect to the clamping parts (3, 4), wherein, in the neutral position, a mirror plane (Ls) of the clamping parts (3, 4) and a longitudinal axis (Lo) of the sill/lintel-attachment part (2) are at an angle of 5-15 degrees.

9 Claims, 5 Drawing Sheets

(56) References Cited

U.S. PATENT DOCUMENTS

| | | | | |
|---|---|---|---|---|
| 6,704,966 | B1 * | 3/2004 | Kao | 16/252 |
| 6,766,561 | B1 * | 7/2004 | Cheng | 16/235 |
| 6,826,870 | B2 * | 12/2004 | Chiang | 49/388 |
| 6,925,685 | B2 * | 8/2005 | Chen | 16/332 |
| 6,966,150 | B2 * | 11/2005 | Chiang | 49/388 |
| 7,010,832 | B2 * | 3/2006 | Chen | 16/252 |
| 7,107,723 | B2 * | 9/2006 | Chiang | 49/388 |
| 7,114,292 | B2 * | 10/2006 | Chiang | 49/388 |
| 7,127,777 | B2 * | 10/2006 | Chiang | 16/252 |
| 7,188,390 | B2 * | 3/2007 | Cheng | 16/252 |
| 7,305,797 | B2 * | 12/2007 | Chiang et al. | 49/388 |
| 7,343,644 | B2 * | 3/2008 | Elmer | 16/229 |
| 7,594,302 | B2 * | 9/2009 | Balenzano | 16/252 |
| 7,900,319 | B2 * | 3/2011 | Bacchetti | 16/252 |
| 7,917,994 | B2 * | 4/2011 | Bai | 16/252 |
| 8,528,169 | B1 * | 9/2013 | Yu | 16/51 |
| 2005/0050685 | A1 * | 3/2005 | Chen | 16/332 |
| 2008/0083086 | A1 * | 4/2008 | Lin | 16/252 |
| 2008/0083087 | A1 * | 4/2008 | Lin | 16/252 |
| 2008/0168621 | A1 * | 7/2008 | Lin | 16/252 |
| 2012/0079682 | A1 * | 4/2012 | Cheng | 16/252 |
| 2012/0279015 | A1 * | 11/2012 | Hung | 16/297 |
| 2013/0160238 | A1 * | 6/2013 | Cheng | 16/54 |

* cited by examiner

HINGE FOR A PANEL DOOR, IN PARTICULAR FOR A COOLING CUPBOARD

BACKGROUND OF THE INVENTION

The invention relates to a hinge for a panel door, in particular for a glass door, specifically for use in a cooling cupboard.

Such hinges are generally known. U.S. Pat. No. 5,297,313, for example, describes a first embodiment of such a hinge. In this case, compression springs on a pivot pin exert a force on the pivot pin which forces the pivot pin into a neutral position in which the longitudinal axis of an attachment plate and the plane of clamping plates for a panel run parallel. U.S. Pat. No. 6,161,255 shows a variant thereof, in which the pivot pin is provided with recesses so that a door has various "index positions", that is to say positions in which the door remains in position. U.S. Pat. No. 6,519,811 describes a variant in which the force of the compression springs is transferred by means of rolls, the longitudinal axis of which is arranged parallel to the pivot pin.

U.S. Pat. No. 6,966,150 describes a variant provided with adjusting screws to facilitate installation. By means of these, the neutral position of a pivot pin can be adjusted, however, only over a very limited angle. Furthermore, especially this type of hinge is prone to wear over time, as the pivot pin is seated in a spindle alignment hole, and regular adjustment of the neutral position will be needed during actual use. US2005/050685 discloses an angular adjustment arrangement of a pivot hinge, wherein a pivot pin is clamped in a joint seat. Such a clamping of a pivot pin will inevitably result in angular position change during use of the hinge, and thus necessitates regular adjustment after periods of use. U.S. Pat. No. 4,416,086 discloses an adjustable door mounting arrangement for refrigerated display cabinets. From its intended use (refrigerated display cabinet), the doors need to be provided with a frame which closes off in a frame mount completely. With the usual applications of the known hinges for shower doors, the glass doors will not have a stop and the neutral position is important. The more recent U.S. Pat. No. 7,305,797 also has such a neutral position.

A problem which has been noted with such hinges during heavy use, in particular when the panel door is made from a relatively heavy material, such as for example glass, is that the closure is unsatisfactory and deteriorates during use. In addition, the hinge is not optimal for uses other than those described in the prior art.

SUMMARY OF THE INVENTION

It is an aim of the invention to provide a hinge for a door panel which in itself is known per se, in particular for a glass panel door, for other applications than have hitherto been customary.

In addition to, or in particular, it is an aim of the invention to provide such a hinge in which neat closure of the door is important.

To this end, the invention provides a hinge for a panel door, in particular a glass door, for sealing a space, such as for example a cooling cupboard, wherein the hinge comprises a sill/lintel-attachment part, two mutually connectable clamping parts for clamping a panel in between them along an edge of the panel, a pivot pin which connects, on one side, to the sill/lintel-attachment part and, on the other side, to the clamping parts in such a manner that they can pivot with respect to one another, and tensioning parts which force the sill/lintel-attachment part into a neutral position with respect to the clamping parts, wherein, in the neutral position, a mirror plane of the clamping parts and a longitudinal axis of the sill/lintel-attachment part are at an angle of 5-15 degrees.

By choosing such a hinge, closure of the panel door is ensured as much as possible, also in case of heavy use. It has been found that this very simple measure prevents the above-mentioned problem in a very simple manner. Alternative or improved embodiments are described in the dependent claims.

In an embodiment, the tensioning parts engage with the pivot pin. In this way, a neutral position can be achieved in a simple manner.

In an embodiment, the pivot pin is connected to the sill/lintel-attachment part in a non-rotatable manner, as a result of which a solid structure can be achieved.

In an embodiment, the tensioning parts are positioned opposite one another, the pivot pin comprises mutually opposite stops for the tensioning parts, and the pivot pin is non-rotatably connected to the sill/lintel-attachment part, wherein a connecting line of the pivot pin stops runs substantially parallel to the mirror plane of the clamping parts. As a result thereof, the neutral position can be set in a simple manner.

In an embodiment, the hinge is furthermore provided with a seat which mutually connects the clamping parts at a distance from one another, wherein the pivot pin is rotatably held in the seat, and the seat is provided with the tensioning parts, on which seat the tensioning parts have a line of action which is, functionally, substantially parallel to the neutral position.

The invention furthermore relates to a cooling cupboard provided with at least one glass door, at least two opposite hinges, as described above, on the glass door, and a stop for the glass door, wherein the stop is positioned in order to keep the door in a position in which the longitudinal axis and the mirror plane are substantially parallel, and the neutral position of at least one hinge is inwards beyond the stop.

By using such a hinge, secure closure of the glass doors can be ensured, even in case of heavy use. In addition, a cooling cupboard having an attractive appearance can be produced, and the energy consumption can be reduced.

The invention furthermore relates to a device provided with one or more of the characteristic measures described in the attached description and/or illustrated in the attached drawings.

It will be clear that the various aspects mentioned in this patent application can be combined and may each be considered individually for a divisional patent application.

BRIEF DESCRIPTION OF THE FIGURES

The attached figures illustrate an embodiment of a hinge according to the invention, in which.

DESCRIPTION OF EMBODIMENTS

Figure 1:
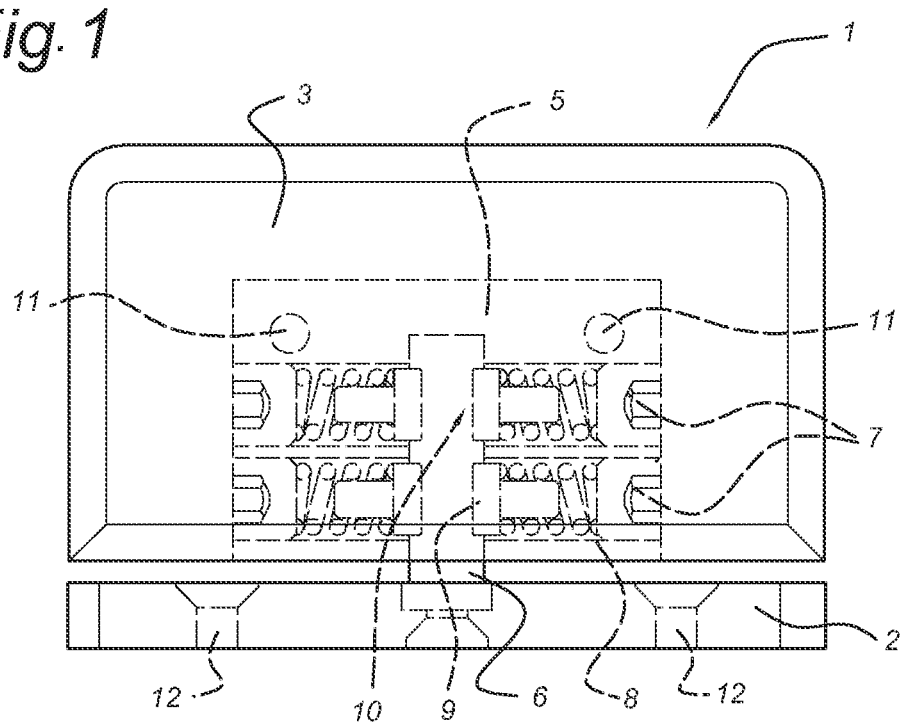
FIG. 1 shows a front view of a hinge according to an embodiment of the invention.
Figure 2:
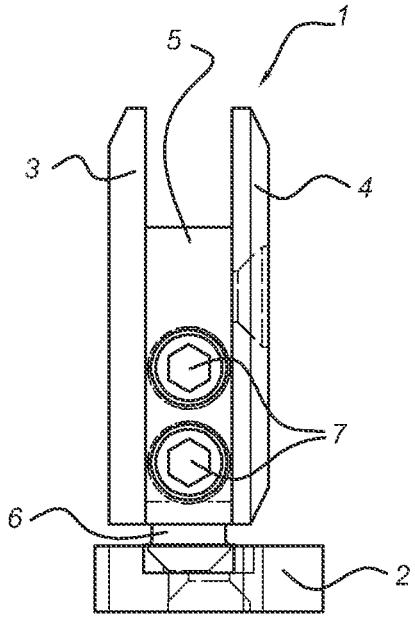
FIG. 2 shows a side view of FIG. 1.
Figure 3:
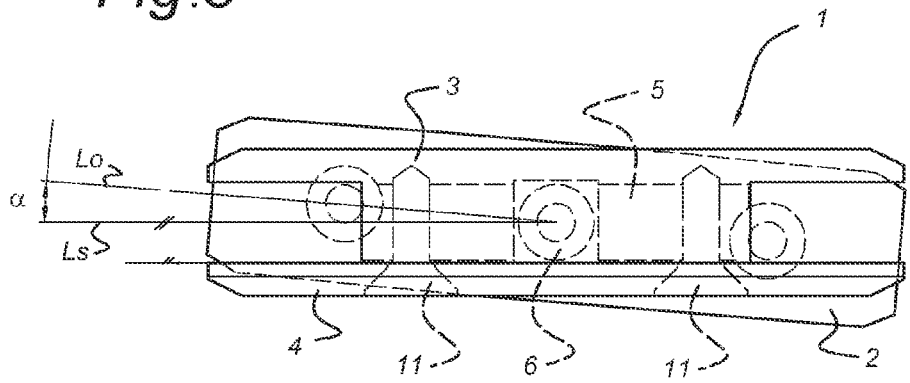
FIG. 3 shows a top view of FIG. 1.

FIG. 1 shows a front view of an embodiment of a hinge 1 for a panel, such as a glass door. FIG. 2 shows the hinge from FIG. 1 in side view, and FIG. 3 shows the hinge from FIG. 1 in top view. It will be clear that such a hinge may have many embodiments, as is, inter alia, illustrated in the above-described prior art. In the embodiment illustrated in FIGS. 1-3, the hinge 1 has a sill/lintel-attachment part 2 which can be connected to the fixed surroundings, in many cases a sill or lintel. In the sill/lintel-attachment part 2, here in the form of a plate, two holes 12 are provided by means of which the sill/lintel-attachment part 2 can be attached to a lintel or sill, for example a sill, by means of screws.

Hinge 1 furthermore has two clamping parts 3 and 4 which are in this case connected to one another. In between these clamping parts, a panel, such as a glass panel, can be clamped. The clamping parts are in this case connected to one another by means of bolts 11 (e.g. countersunk head screws to form a smooth surface of the hinge 1). Between the clamping parts, a seat 5 is present which keeps the clamping parts 3, 4 at a minimum mutual distance. The seat furthermore provides a seat for a pivot pin 6. In the illustrated embodiment, the pivot pin 6 is non-rotatably connected to sill/lintel-attachment part 2. Furthermore, the pivot pin 6 is rotatable in seat 5.

In this case, the pivot pin 6 is provided with stops 10. In this embodiment, opposite parts 6*c* of the pivot pin 6 which have been flattened have been chosen. A connecting line Ls of the pivot pin stops 10 runs substantially parallel to the mirror plane of the clamping parts 3, 4. Furthermore, seat 5 is provided with tensioning parts in the form of four tensioning parts 7, 8, 9 which are situated opposite one another and which are pretensioned in the fitted position in order to exert a pressure force on the stops 10. In the embodiment shown, four sets of tensioning parts 7, 8, 9 have been used. As a result thereof, the seat 5 is forced into a stable balanced position with respect to the pivot pin 6. Since the connecting line Ls here makes an angle $\alpha$ with respect to the longitudinal axis Lo of sill/lintel-attachment part 2, and the pivot pin is rotatably fitted in seat 5, the hinge will, in the balanced position, be in the position which is clearly shown in FIG. 3.

The stops 10 may be flat stop faces 6*c*, and the tensioning parts 7, 8, 9 may be coil springs 8 held in position using fixation elements 7, optionally provided with pressure parts 9 illustrated here. Instead of opposite flat stop faces on the pivot pin 6 and on the pressure parts 10 on the coil springs 8 which are pretensioned on the flat stop face, resulting in a (stable) balance of the pivot pin 6 as described, a different construction for keeping the pivot pin 6 in a stable balance with respect to seat 5 is also conceivable. Thus, the stop faces may be concave and the tensioning parts may have a convex surface. In this case, the radius of curvature of the tensioning parts is preferably smaller than that of the concave surfaces of the pivot pin. Connecting line Ls can then be the line of symmetry through the concave surfaces. Alternatively, the pivot pin 6 may be provided with resilient parts which engage with the seat 5 and again force the pivot pin 6 and the seat 5 into a neutral position with respect to one another.

It is even conceivable for the pivot pin 6 in one construction to be fixedly connected to seat 5, and to be rotatably held in sill/lintel-attachment part 2. In this arrangement, the tensioning parts 7, 8, 9 may be provided in the sill/lintel-attachment part 2 and may, for example, have the features described above.

Figure 4:
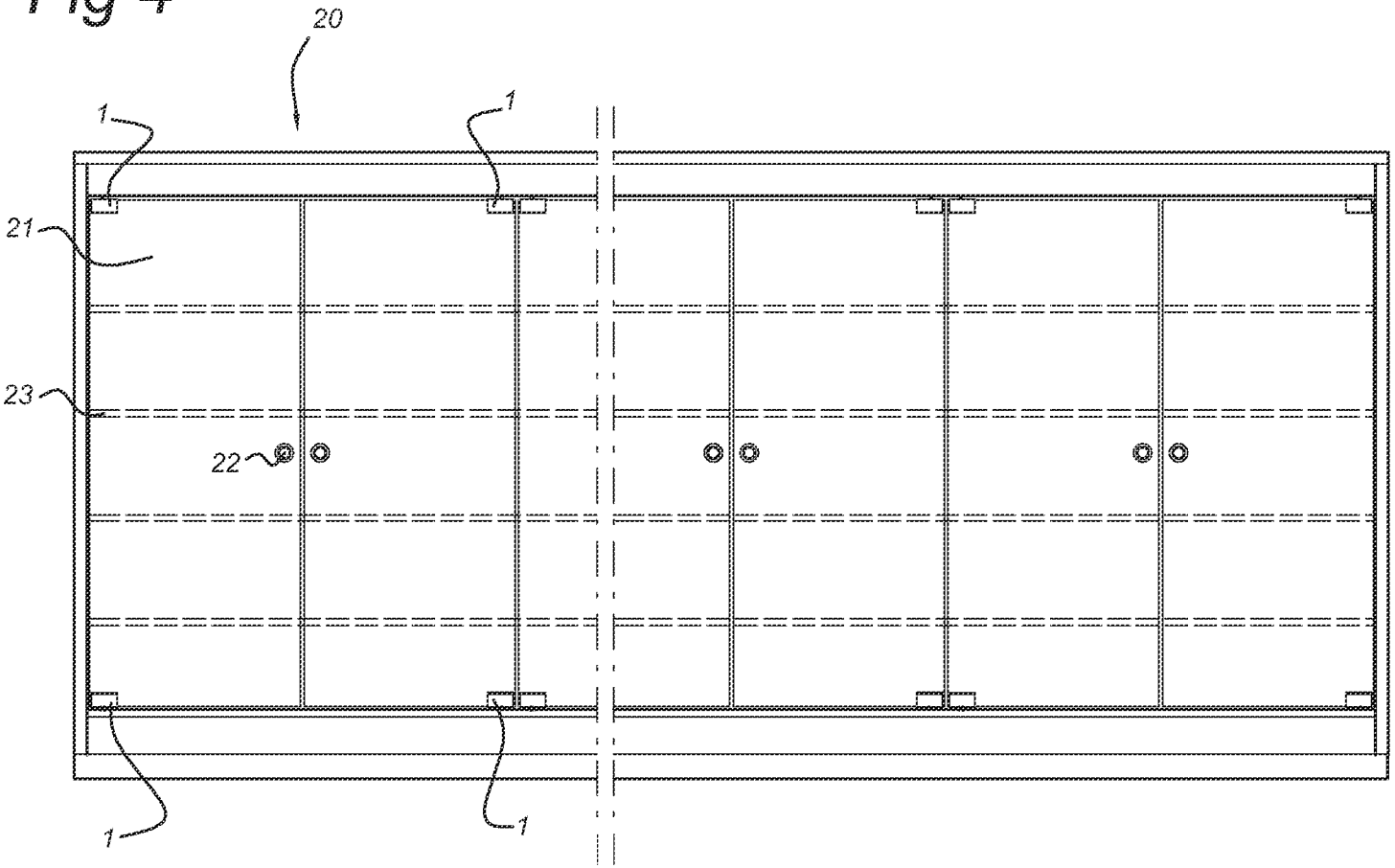
FIG. 4 shows the application of the hinge from FIG. 1 in a cooling cupboard, for example for use in a supermarket.

FIG. 4 shows an application of hinge 1 in a cooling cupboard 20, as is used, for example, in a supermarket. In this case, the sill/lintel-attachment parts 2 of the hinges 1 are attached with the longitudinal axis substantially in one plane, on the top side and the bottom side of the cooling cupboard 20. Glass panel doors 21 are clamped between the clamping parts 3, 4 of the hinges 1. In the cooling cupboard, shelves for products to be cooled are illustrated by means of dashed lines. The glass panel doors 21 are furthermore provided with handles 22 for opening the glass doors 21.

Inside the cooling cupboard 20, stops (not shown) are provided, substantially in one plane with respect to one another. The stop face will, functionally, be substantially parallel to the plane of the longitudinal axes of the sill/lintel-attachment parts 2. In such an arrangement, the neutral position of the mirror plane of the clamping parts 3, 4 is situated in an angle beyond the stop face. As a result thereof, the doors 21 are securely resting against the stops, as a result of which the hinges 1 do not have to be retensioned regularly in case of heavy use. In addition, the doors 21 close well, so that gaps are prevented and the heat stays outside the cooling cupboard 20.

In FIG. 5-8, a further embodiment is shown in various cross sectional and detail views. In this exemplary embodiment, various elements are present, which alone or in combination might also be added to the embodiment shown in FIGS. 1 and 2.

Figure 5A:
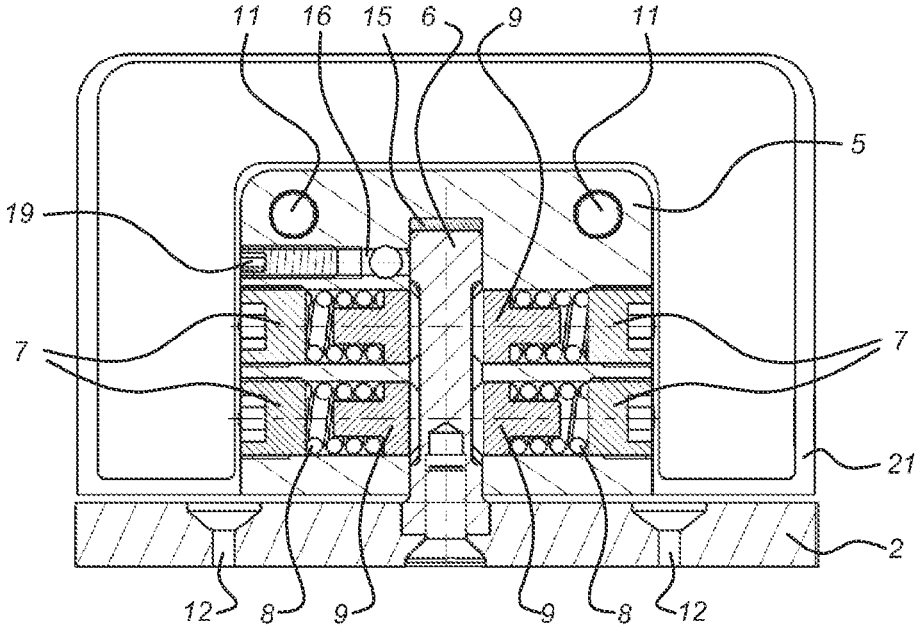
FIGS. 5*a* and 5*b* show cross sectional vies of a further embodiment of the hinge according to the present invention.
Figure 5B:
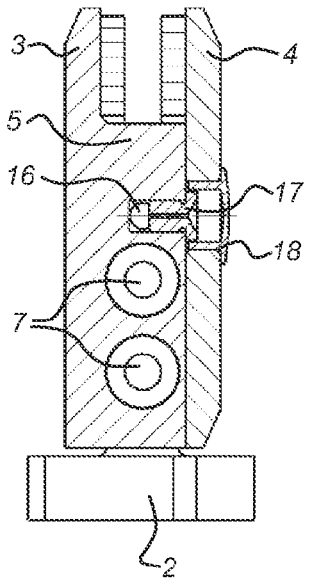

FIG. 5*a* shows a further embodiment in cross sectional view from a side parallel to the glass door to which the hinge 1 is to be attached, and FIG. 5*b* shows a cross sectional view from the perpendicular direction of FIG. 5*a*.

As shown most clearly in the side view of FIG. 5*b*, the seat 5 of the hinge 1 is combined with one of the clamping parts 3, 4 in this embodiment. Thus, less parts are needed when actually installing the hinge 1, and also manufacturing is easier than a separate seat 5.

In this embodiment, the hinge 1 further comprises a lubrication channel 16, the lubrication channel 16 running from a lubrication opening on one of the clamping parts (in this case front side clamping part 4) to a space in the seat 5 for the pivot pin 6. E.g. the lubrication channel 16 runs to a top part of the space in seat 5, allowing gravitational feed of lubricant around the pivot pin 6. The lubrication channel 16 is easy to manufacture in the seat 5 part of the hinge 1 by a straight through hole (e.g. using drilling or milling), which can be closed off using e.g. a head screw bolt 19. Furthermore, only a straight drilling hole is needed in the front side clamping part 4 and seat 5 at a spot corresponding to the channel 16 in the seat (e.g. perpendicular). The lubrication opening can then be safely further closed off for actual use using a grease nipple 17 and a cover plug 18. When needed, only the cover plug 18 needs to be removed for lubrication of the hinge, without any need to disassemble the hinge 1 and/or hinged door 21.

As a further functional element, the embodiment of FIGS. 5*a* and 5*b* comprises a pivot pin plate 15, mounted in the top part of the space in seat 5 for the pivot pin 6. This allows a better pivoting motion and prevents or decreases excessive wear of the seat 5 at that location during actual use.

Figure 6:
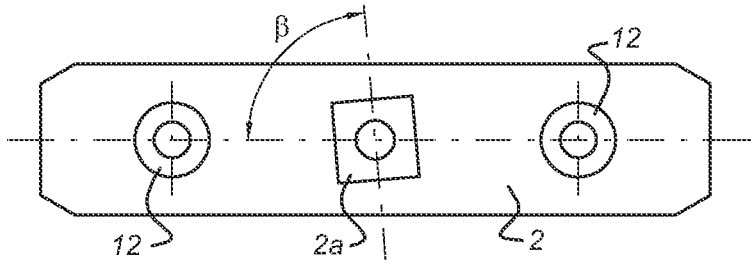
FIG. 6 shows a top view of the sill/lintel-attachment part of the hinge of FIGS. 5*a* and 5*b;*
Figure 7:
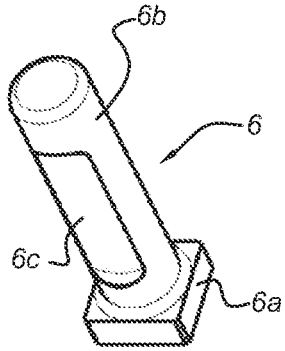
FIG. 7 shows a perspective view of the pivot pin used in the hinge of FIGS. 5*a* and 5*b*.

FIG. 6 shows a top view of the sill/lintel-attachment part 2 in this embodiment. Along the longitudinal axis of the attachment part 2, the two holes 12 are provided for mounting the attachment part 2 to a sill or lintel or other similar door frame part. In the middle part, an opening 2*a* is provided for mounting of the pivot pin 6. The pivot pin 6 in this embodiment is shown in perspective view in FIG. 7, and comprises a square shaped mounting base 6*a*, a cylinder shaped part 6*b*, and two straight faces 6*c*, which in operation form the stops 10 as described above. The mounting base 6*a* fits directly in the opening 2*a*, as a result of which the pivot pin 6 cannot rotate with respect to the attachment part 2. The opening 2*a* is in the embodiment shown rectangular, having sides forming an angle $\beta$ with the longitudinal axis of the attachment part 2. This angle $\beta$ corresponds to the angle 90-$\alpha$ as discussed above with reference to FIG. 3, and provides in combination with the shape of the pivot pin 6 the pre-set angle in the neutral position of the hinge 1.

Figure 8:
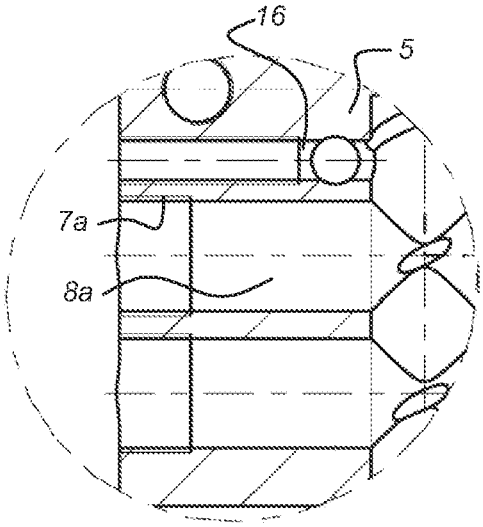
FIG. 8 shows a detailed cross sectional view of the seat of the hinge of FIGS. 5*a* and 5*b*.

FIG. 8 shows a detail view in cross section of the openings 8*a* in the seat 5 in which the tensioning parts 7, 8, 9 are positioned during operation. The seat 5 is provided with an opening 8*a* for the tensioning parts 7, 8, 9, and the tensioning parts comprise a pressure part 9, coil spring 8 and a fixation element 7. The opening 8*a* being is provided on its inside surface with a screw threat 7*a* for engagement with the fixation element 7 over only a part of the length of the opening 8*a*. The fixation element 7 is 9 as in the embodiment discussed above) e.g. a head screw. Using the screw threat 7*a* on the inside surface over only a limited length allows to use such a fixation element 7 without a risk of the fixation element 7 being mounted to far to the inside of the seat 5 of the hinge 1. Furthermore, as the coil spring 8 in this case only is in contact with the straight surface part of the opening 8*a*, no wear is present during operational use of the hinge 1.

In further embodiments, the pivot pin 6 is made of a hardened steel material, such as AISI440B. The same may be embodied for the pressure parts 9, which in operation are in moving contact with the stops 10 of the pivot pin 6. The material used for these parts may be hardened and tempered to provide sufficient wear resistance. A hardness in the region of more than 50 HRC (e.g. 55-57 HRC) is used in a specific embodiment. HRC is one of the Rockwell hardness scales used in the relevant industry, which is well known, and e.g. standardized according to ISO 6508-1 or ASTM E18.

It is noted that in further embodiments, a marking may be provided on the lower part of the combination of seat 5 and one of the clamping parts 3, 4. This marking is not visible during actual use of the hinge 1, yet it is possible to verify the origin of the hinge after installation, by simply opening the glass panel door 21.

It will be clear that the above description has been given in order to illustrate the functioning of preferred embodiments of the invention, and not in order to limit the scope of the invention. On the basis of the above explanation, many variations which fall within the spirit and the scope of the present invention will be obvious to a person skilled in the art.

The invention claimed is:

1. A hinge for a panel glass door for sealing a space, wherein the hinge comprises:

a sill/lintel-attachment part defining a longitudinal axis, two mutually connectable clamping parts for clamping a panel in between them along an edge of the panel, and defining between them a mirror plane, a pivot pin fixed to one of the sill/lintel-attachment part and the clamping parts, which connects, on one end, to the sill/lintel-attachment part and, on the other end, to the clamping parts in such a manner that the sill/lintel-attachment part and the clamping parts can pivot with respect to one another, wherein the mirror plane of the clamping parts extends radially from a pivot axis of the sill/lintel-attachment part and the clamping parts, tensioning parts which force the sill/lintel-attachment part into a neutral position in which the sill/lintel-attachment is in equilibrium with respect to the clamping parts, wherein, in the neutral position, the mirror plane of the clamping parts and the longitudinal axis of the sill/lintel-attachment part are at an angle of 5-15 degrees, and a lubrication channel, the lubrication channel running from a lubrication opening on one of the clamping parts to a top part of the pivot pin when the hinge is assembled.

2. The hinge of claim 1, wherein the tensioning parts engage with the pivot pin.

3. The hinge of claim 1, wherein the pivot pin is non-rotatably connected to the sill/lintel-attachment part.

4. The hinge of claim 1, wherein the tensioning parts are positioned opposite one another, the pivot pin comprises mutually opposite stops for the tensioning parts, and the pivot pin is non-rotatably connected to the sill/lintel-attachment part, wherein a line connecting the opposite stops is parallel to the mirror plane of the clamping parts.

5. The hinge of claim 1, wherein the hinge is furthermore provided with a seat defined by a distance between the clamping parts, wherein the pivot pin is rotatably held in the seat, and the seat is provided with the tensioning parts, on which seat the tensioning parts have a line of action which, in the neutral position, is parallel to the neutral position.

6. The hinge of claim 1, wherein the pivot pin is made of a hardened steel material.

7. The hinge of claim 1, wherein the seat is provided with an opening for the tensioning parts, the tensioning parts comprise a stop, coil spring and a fixation element, the opening being provided on its inside surface with a screw thread for engagement with the fixation element over only a part of the length of the opening.

8. A cooling cupboard provided with at least one glass door, at least two opposite hinges according to claim 1 attached to the glass door, and a stop for the glass door, wherein the stop is positioned to keep the glass door in a position in which an angle between the longitudinal axis and the mirror plane is less than the angle between the longitudinal axis and the mirror plane in the neutral position, and the neutral position of at least one hinge is inwards beyond the stop.

9. The hinge of claim 2, wherein the tensioning parts are urged into contact with the pivot pin along a direction that is perpendicular to an axis of the pivot pin.

* * * * *